US006206139B1

(12) United States Patent
Bogart, Jr.

(10) Patent No.: US 6,206,139 B1
(45) Date of Patent: Mar. 27, 2001

(54) FOLDING TRIPOD LADDER HAVING EXTENDABLE LEGS

(76) Inventor: Robert C. Bogart, Jr., P.O. Box 1109, Bagdad, AZ (US) 86321

( * ) Notice: Subject to any disclaimer, the term of this patent is extended or adjusted under 35 U.S.C. 154(b) by 317 days.

(21) Appl. No.: 08/732,887

(22) Filed: Oct. 17, 1996

(51) Int. Cl.[7] ..... E06C 1/00

(52) U.S. Cl. ..... 182/173; 182/96; 182/166; 182/170

(58) Field of Search ..... 180/67.4, 66.1, 180/68.1, 69.1, 69.4, 93, 108, 109, 111, 96, 97, 104, 105, 124, 158, 166, 194, 207, 170, 172, 173

(56) References Cited

U.S. PATENT DOCUMENTS

| | | | | |
|---|---|---|---|---|
| 419,821 | * | 1/1890 | Burrows | 182/170 |
| 461,366 | | 10/1891 | Odom . | |
| 538,570 | | 4/1895 | White | 290/281 |
| 569,170 | | 10/1896 | McCormick | 182/180 |
| 621,479 | * | 3/1899 | Stephenson | 182/166 |
| 947,409 | * | 1/1910 | Hudson | 182/166 |
| 970,560 | | 9/1910 | Samuelson | 228/31 |
| 1,354,166 | * | 9/1920 | Busko | 182/108 |
| 1,866,974 | | 7/1932 | Hohing et al. | 290/283 |
| 1,873,107 | | 8/1932 | Blosser | 182/170 |
| 2,305,985 | * | 12/1942 | Obermeyer | 182/172 |
| 2,500,333 | * | 3/1950 | Young | 182/170 |
| 2,580,045 | | 12/1951 | Reed | 290/278 |
| 2,650,014 | | 8/1953 | Harrison | 182/170 |
| 3,165,169 | | 1/1965 | Machen | 182/170 |
| 3,189,124 | | 6/1965 | Rateau | 182/170 |
| 3,878,917 | | 4/1975 | McBride | 182/172 |
| 4,029,223 | * | 6/1977 | Adamski et al. | 182/96 X |
| 4,366,940 | | 1/1983 | Vargas | 248/542 |
| 4,524,849 | | 6/1985 | Riddle | 182/170 |
| 4,796,727 | | 1/1989 | Eaton | 182/168 |
| 4,846,305 | * | 7/1989 | Kupfert | 182/97 |
| 4,899,849 | | 2/1990 | Levi et al. | 182/172 |
| 5,590,739 | * | 1/1997 | High et al. | 182/172 X |
| 5,722,507 | * | 3/1998 | Kain | 182/104 X |

FOREIGN PATENT DOCUMENTS 9211425 7/1992 (WO) .

* cited by examiner

*Primary Examiner*—Bruce A. Lev
(74) *Attorney, Agent, or Firm*—Frank J. McGue

(57) ABSTRACT

A ladder comprises a top step, two leg assemblies mounted to the top step, and a step assembly mounted to the top step. The leg assembly and the step assembly pivot from a closed position in which the leg assemblies and the step assembly are extend vertically downward from the top step to an angular position in which the leg assemblies and the step assembly are angularly displaced from vertical and oriented along radial axes positioned 120 degrees from one another in a tripod configuration. Each leg assembly and the step assembly are locked to the selected angular position. The length of each leg assembly can be adjusted as desired. The step assembly includes a plurality of steps. Each of the leg assemblies and the step assembly have a foot for engaging the ground.

11 Claims, 4 Drawing Sheets

16
10
78
78
30
12
3
74
18
76a
3
77
12
74
44
14
4
20
4
86
86
98
92
5
84
88
98
90
92

50
12
52
54
56
50
20
48

88
96
90
98
94
92

78
80
16
28
22
10
12
42
39
32
32
77
18
76a
75
14
76b
80
82

FOLDING TRIPOD LADDER HAVING EXTENDABLE LEGS

TECHNICAL FIELD

This invention relates to the field of foldable ladders, and, more particularly, to foldable ladders having a tripod configuration with extendable legs.

BACKGROUND OF THE INVENTION

Various types of foldable ladders are well known in art. Such ladders provide a means for an individual to climb to or reach heights using a free standing ladder in contrast to extension ladders which are braced against a structure when is use.

Ensuring the stability of such a ladder is critical for safety purposes. When the center of gravity of the ladder and user combination falls outside the ladder footprint, any ladder will topple. Thus, the large triangular footprint of a tripod configuration is desirable. However, even tripod configurations can be unstable when used on an uneven flat terrain. This is particularly true when the tripod is not a true tripod in that the legs which bracket the steps both engage the ground as one ridged unit. Such an arrangement means unevenness in any of four points and will cause instability in the ladder.

Various solutions have been devised in attempts to overcome the problem. WIPO Patent Application PCT/US90/07498 entitled IMPROVED TRIPOD LADDER to Baker which published on Jul. 9, 1992 discloses a tripod ladder having legs that rotate about a pivot pin held between rear leg extensions. The legs are maintained in a 120 degrees orientation from one another by lips which form alignment channels.

U.S. Pat. No. 4,524,849 entitled TRIPOD issued on Jun. 25, 1985 to Riddle discloses a tripod ladder for use on uneven ground. The second or third leg portions can be provided in a telescoping or shortening manner on at least one of the legs.

U.S. Pat. No. 3,165,169 entitled LADDER HOLDER issued on Jan. 12, 1965 to Machen discloses a tripod type ladder holder having adjustable leg portions composed of upper tubular leg portions which telescope for adjustment into lower leg portions.

U.S. Pat. No. 3,189,124 entitled LADDER issued on Jun. 15, 1965 to Rateau shows a ladder having a sole which engages the ground.

None of the known prior art disclose the combination set forth herein.

SUMMARY OF THE INVENTION

It is an object of this invention to provide a stable ladder for use on all terrain, whether even or uneven.

It is a further object of this invention to provide a tripod ladder having legs oriented at 120 degrees from one another for maximum stability.

It is still another object of this invention to provide a tripod ladder having extendable legs.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
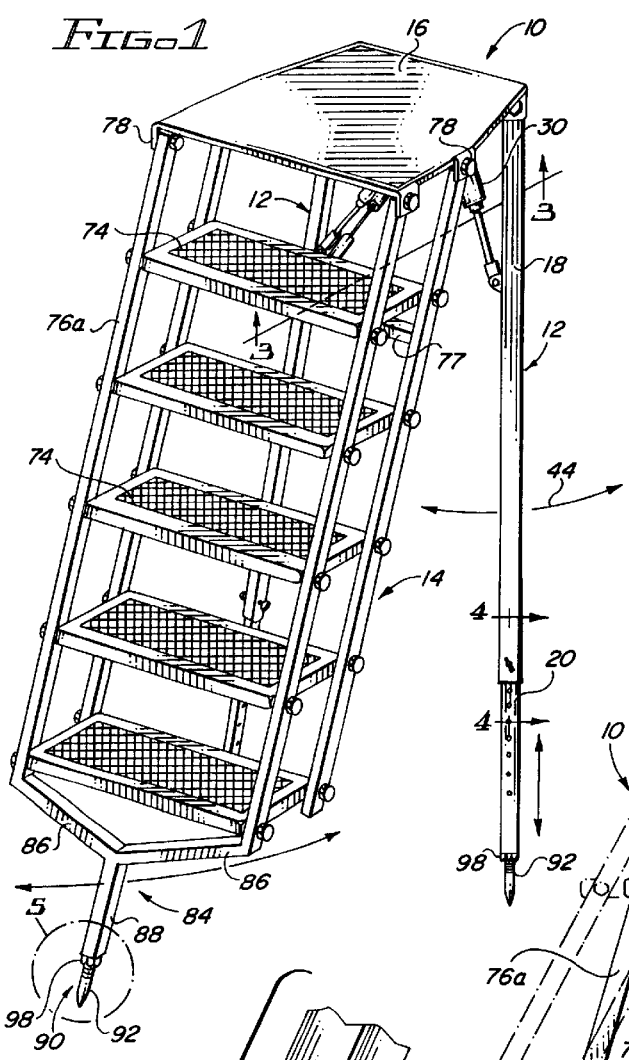
FIG. 1 is a perspective view of one embodiment of the present invention.

Referring more particularly to the drawings by characters of reference, FIGS. 1–5 disclose one embodiment of a ladder 10. The ladder comprises a top step 16, two leg assemblies 12 mounted to top step 16, and a step assembly 14 also mounted top step 16. Each leg assembly 12 has means for adjusting the length thereof and a foot 90. The step assembly has a plurality of steps 74 and also a foot 90.

The present invention includes means for pivoting leg assemblies 12 and step assembly 14 from a closed position in which the leg assemblies 12 and the step assembly 14 extend vertically downward from top step 16 to a desired angular position in which the leg assemblies and the step assembly are angularly displaced from vertical and oriented along radial axes positioned 120 degrees from one another in a tripod configuration. The present invention further comprises means for locking each leg assembly 12 and step assembly 14 to the desired angular position.

Figure 2:
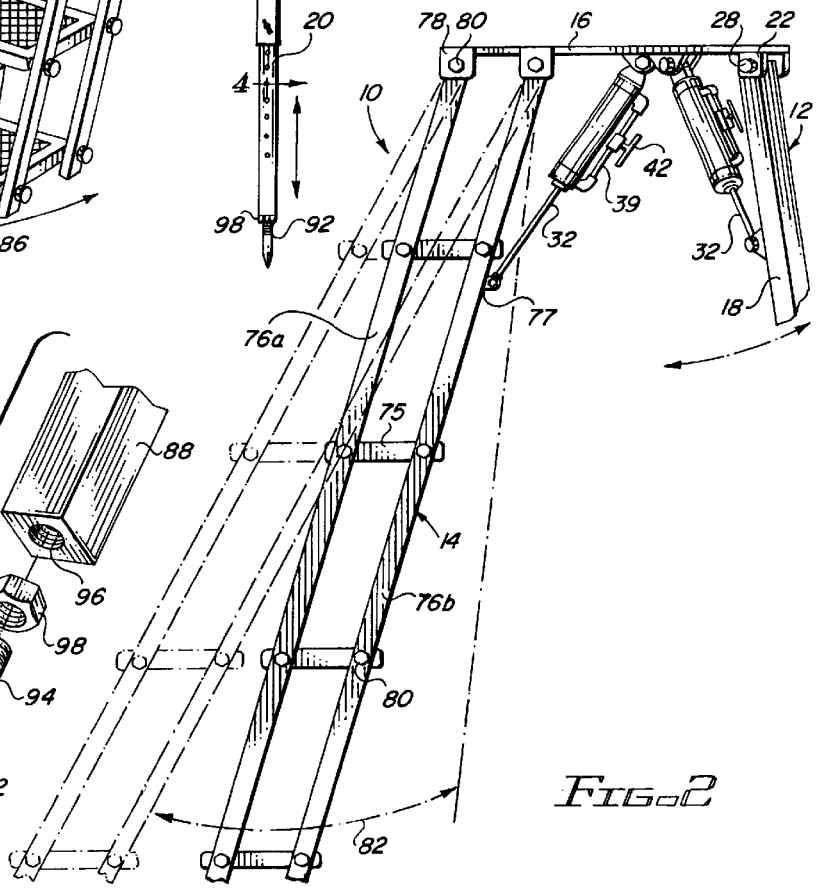
FIG. 2 is a side view of the device depicted in FIG. 1.
Figure 3:
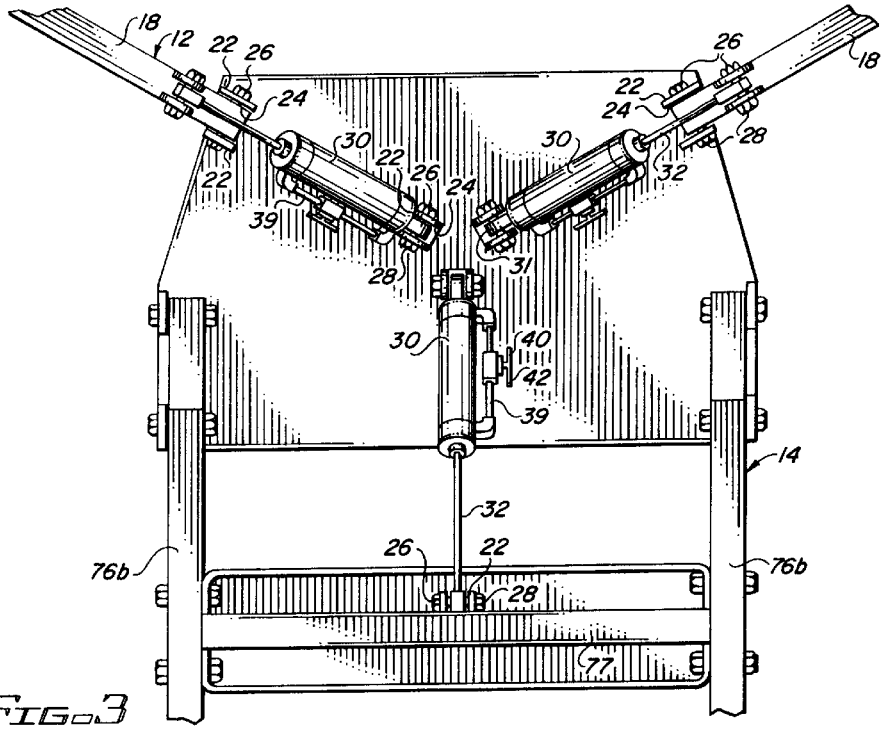
FIG. 3 is a bottom view of the device depicted in FIG. 1 taken along line 3—3.

As best seen in FIGS. 2 and 3, leg assemblies 12 and step assembly 14 are mounted to the bottom of a top step 16. In the illustrated embodiment, each leg assembly 12 includes an upper square tube 18 and a lower square tube 20. Lower square tube 20 is slidably received within upper square tube 18 in a telescoping manner as described further below.

The top of each upper square tube 18 is pivotally received between two lips 22 which, in combination, form alignment channels 24. In the illustrated embodiment, means for pivoting is provided by a bolt 26 extending through lips 22 and mating holes in the top of upper square tube 18. Bolt 26 is secured thereto via a nut 28. The pivoting means allows a user to extend leg assemblies 12 outward while alignment channels 24 limit the leg assemblies to the preferred 120 degree orientation. The above example of pivoting means is provided for illustrative purposes. Those skilled in the art will recognize that many other pivoting means are possible in the present invention. Any pivoting means which allows rotation of leg assemblies 12 as described herein would be suitable for use in the present invention.

Figure 10:
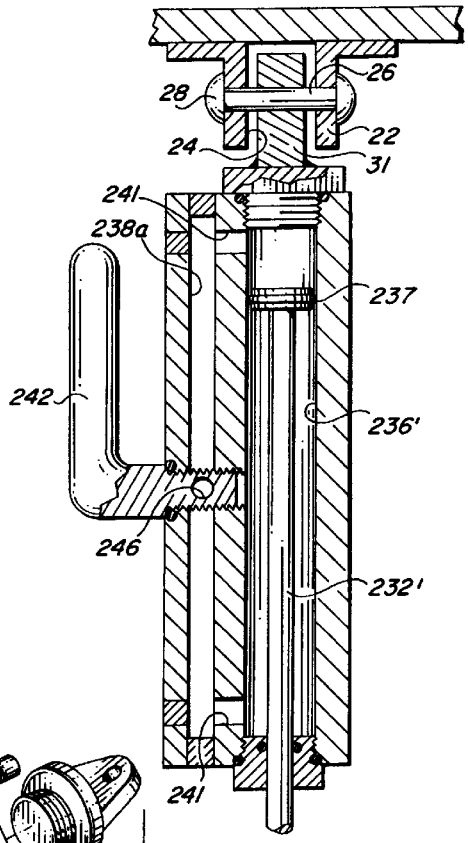
FIG. 10 is a cross sectional side view of an alternate embodiment of cylinders for use in connection with the present invention.
Figure 11:
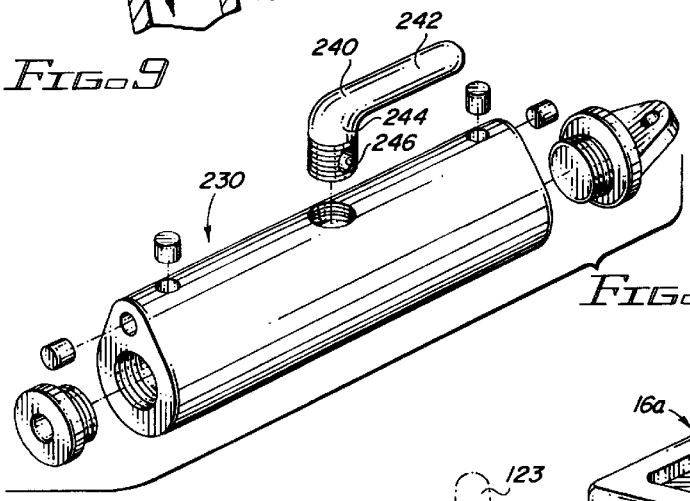
FIG. 11 is an expanded perspective view of the alternate embodiment of the cylinder depicted in FIG. 10.

Means for locking each leg assembly 12 to the desired outward extension are also provided. In the illustrated embodiment of FIG. 1, such locking means comprises two hydraulic cylinders 30. Alternatively, two hydraulic cylinders 230 are provided as illustrated in FIGS. 10–11.

A closed end 31 of each corresponding hydraulic cylinders 30 is centrally and pivotally mounted to the bottom of top step 16. Each hydraulic cylinder is aligned in parallel with the corresponding leg assembly 12 in the preferred 120 degree orientation. The opposite end of the hydraulic cylinder, namely a shaft 32, is pivotally mounted to the corresponding upper square tube 18.

In the presently preferred embodiment, means for pivoting the respective ends of each hydraulic cylinder is provided by lips 22 forming alignment channels 24, bolts 26 extending through closed end 31 and shaft 32, and nuts 28 as previously described in connection with mounting upper square tube 18 to top step 16. The pivoting means allows a user to extend leg assemblies 12 outward while alignment channels 24 limit the leg assemblies to the preferred 120 degree orientation. The illustrated hydraulic cylinders 30 are available from Grainger, Inc. of Phoenix, Ariz. as the SpeedAire Double Acting Pivot Mount, Part No. 6W130. An alternate embodiment of hydraulic cylinder 30 denoted 230 is shown in FIGS. 10–11. Hydraulic cylinder 230 differs from the previous hydraulic cylinder 30 in showing a more enclosed design.

In hydraulic cylinder 30, a U-shaped tube 39 provides fluid communication between the interior of tube 39 and cavity 36 (not shown).

As best seen in FIG. 10, hydraulic cylinder 230 provides a shaft 232 and piston 234 mounted at one end of shaft 232. Piston 234 is slidably received within a cavity 236 formed within hydraulic cylinder 230. An O-ring 237 provides an air tight seal between that portion of cavity 236 above piston 234 and the portion of cavity 236 below piston 234.

Positioned parallel to cavity 236 within hydraulic cylinder 230 is a connecting cavity 238. Slots 241 connect cavities 236 and 238 at opposing ends thereof to provide fluid communication between cavities 236 and 238.

A two way valve 240 is threadedly is mounted to connecting cavity 238. Valve 240 includes a handle 242 and a leg 244. Leg 244 extends into connecting cavity 238 and includes a hole 246 extending completely through leg 244. Valve 240 is in a closed position when hole 246 is perpendicular to cavity 238 whereby hydraulic fluid cannot pass from the upper end of cavity 238 to the lower end of cavity 238. When valve 240 is in the closed position and a force is exerted downwardly on shaft 232, the hydraulic fluid cannot pass freely through cavity 238. Since hydraulic fluids are not compressible, the hydraulic fluid will prevent any movement of piston 234 and hence shaft 32.

However, valve 240 is in an open position when hole 246 is generally oriented parallel to cavity 238 whereby hydraulic fluid does pass from the upper end of cavity 238 to the lower end of cavity 238. Handle 242 provides a user with means to move valve 240 from the open position to the closed position and vice versa.

When in the open position, hydraulic pressure is equalized between the upper and lower portions of cavities 236 and 238 via slots 241 by movement of hydraulic fluid therebetween. Such pressure equalization allows easy movement of piston 234 and shaft 232. To set up each leg assembly 12 in the desired angular position, the user sets valve 240 to the open position and moves leg assembly 12 to an angular position as desired and shown by arrows 44 in FIGS. 1 and 2. The user uses handle 242 to place valve 240 in a closed position thereby locking hydraulic cylinder 230, and hence leg assembly 12, in the desired angular position.

The above example of locking means is provided for illustrative purposes. Those skilled in the art will recognize that many other locking means are possible in the present invention. Any locking means which prevents rotation of leg assemblies as described herein would be suitable for use in the present invention.

Figure 4:
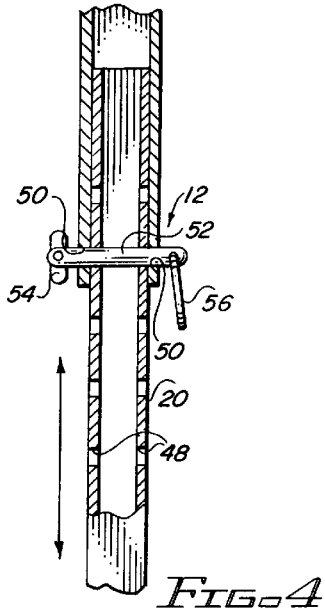
FIG. 4 is a cross sectional side view of one leg of the device of FIG. 1 taken along line 4—4.

Turning now to FIGS. 1 and 4, securing means is designed to hold telescoping lower square tube 20 in a specific spatial relationship with upper square tube 18 thereby setting leg assembly 12 to the desired length. One embodiment of securing means is best seen in FIG. 4. In that embodiment, lower square tube 20 includes a plurality of spaced paired holes 48 which mate with a single pair of corresponding mounting holes 50 in upper square tube 18. A pin 52 extending through mounting holes 50 and paired holes 48 secures upper square tube 18 to lower square tube 20 at a desired height.

At one end of pin 52, a stop 54 is rotatably secured to pin 52. At the opposing end of pin 52, a handle 56 is provided. When stop 54 is oriented perpendicular to pin 52, pin 52 cannot be pulled through holes 48, 50. However, when stop 54 is rotated parallel to pin 52, pin 52 and stop 54 can easily be pulled out via handle 56. With pin 52 removed, lower square tube 20 can be slid up and down within upper tube 18 to the desired length. Once the nearest holes 48 and 50 are aligned, pin 52 can be reinserted. Stop 54 rotated back to the perpendicular position thereby securing pin 52.

Figure 9:
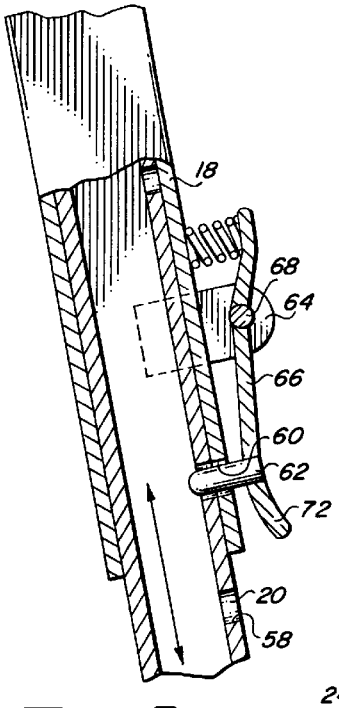
FIG. 9 is a cross sectional side view of an alternate embodiment of one leg.

Turning now to FIG. 9, an alternate securing means embodiment is shown. In that embodiment, a plurality of single holes 58 in lower square tube 20 mate with a securing hole 60 in upper square tube 18. A short pin 62, when extended through holes 58 and 60, secures upper square tube 18 and lower square tube 20 as desired. When short pin 62 is not extended through hole 58, lower square tube 20 can slide within upper square tube 18.

Positioned on the exterior of upper square tube 18 is a mounting arm 64 having a pivot arm 66 mounted thereon at a pivot 68. One end of pivot arm 66 engages a spring 70 which extends between arm 66 and upper square tube 18. Pin 62 is mounted on arm 66 opposite spring 70 in alignment with hole 60. Spring 70 is a compression spring which urges pin 62 into extension through hole 60. Pivot arm 66 extends beyond pin 62 opposite spring 70 to form a handle portion 72. A user grasps handle portion 72 and lifts it away from upper leg 18 to disengage pin 62. Upon release of handle portion 72, spring 70 will urge pin 62 into engagement with hole 60 and any hole 58 in alignment with hole 60, thereby securing leg assembly 12 at the desired length.

As best seen in FIGS. 1 and 2, step assembly 14 comprises a plurality of identical steps 74 held in a spaced parallel relationship by two front mounting arms **76*a* and two middle mounting arms 76*b*, one front mounting arms 76*a* and one middle mounting arm 76*b* paired on each opposing side of top step 16. The corners of each step 74 are rotatably secured to one of the four mounting arms 76 by bolts 80. Bolts 80 extend through each arm 76 into each respective corner of steps 74. Steps 74 are mounted parallel to each other and to top step 16** and equidistant from one another.

The top of each mounting arm 76*a* and 76*b* is rotatably secured to an ear 78 extending downwardly from top step 16 with a bolt 80. As best seen in FIG. 2, each pair of mounting arms 76*a* and 76*b* in combination with top step 16 and each step 74 define a parallelogram wherein each step 74 is parallel to top step 16 (and thus all other steps 74) and the pair of mounting arms 76*a* and 76*b* form the second set of parallel sides. The parallelogram relationship holds as step assembly 14 is rotated as shown by arrow 82 in FIG. 2. Such a relationship maintains steps 74 level for the user no matter how wide the tripod is opened.

Means for locking step assembly 14 is identical to the locking means for each said leg assembly 12 except as to the attachment to the step assembly. In the illustrated embodiment of FIG. 1, such locking means comprises a hydraulic cylinder 30 which is attached to the middle of a horizontal tube 77 mounted between mounting arms 76*b* just below the first step down from top step 16. Alternatively, hydraulic cylinder 230 is provided as illustrated in FIGS. 10–11.

A closed end 31 of each corresponding hydraulic cylinders 30 is centrally and pivotally mounted to the bottom of top step 16. Each hydraulic cylinder is aligned in parallel to the step assembly 14 in the preferred 120 degree orientation from leg assemblies 12. The opposite end of hydraulic cylinder 30, namely a shaft 32, is attached at pivot 33 to a step 74, preferably the middle of horizontal tube 77, preferably mounted just below the first step 74 below top step 16. The operation of hydraulic cylinder 30 (or hydraulic cylinder 230) is identical to the prior discussions relating to leg assemblies 12 and is thus not repeated here.

As best seen in FIG. 1, step assembly 14 includes a Y-shaped base 84 whose arms 86 extend downwardly from front mounting arms 76*a* to join leg 88. Step assembly 14 rests upon foot 90, and, in conjunction with leg assemblies 12, form a true tripod arrangement whereby folding ladder 10 rests upon three points only thereby minimizing the chances of instability.

Figure 6:
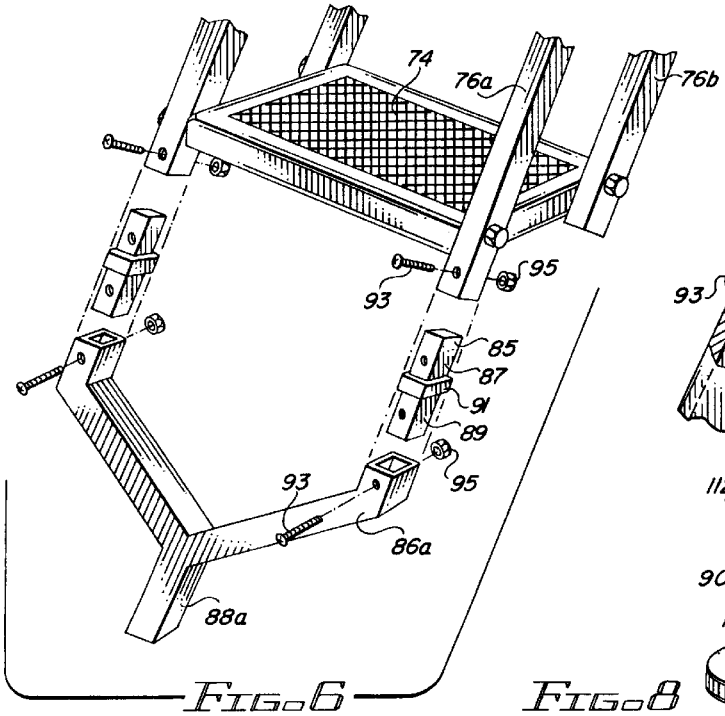
FIG. 6 is an expanded view of an alternate embodiment of the base of the steps depicted in FIG. 1.
Figure 7:
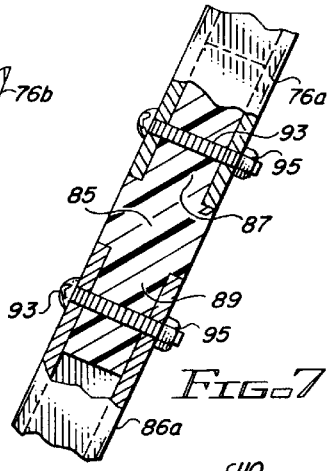
FIG. 7 is a cross sectional side view of the base of the steps depicted in FIG. 6.

A detachable version of Y-shaped base denoted as 84*a* is illustrated in FIGS. 6 and 7. In FIG. 6, arms 86*a* are connected to front mounting arms 76*a* using connector 85. Connector 85 includes two opposing narrow portions 87 and 89 separated by a wider spacer 91. Narrow portions 87 and 89 extend into front mounting arms 76*a* and arms 86*a*, respectively, and are secured thereto by bolts 93 and nuts 95.

Figure 5:
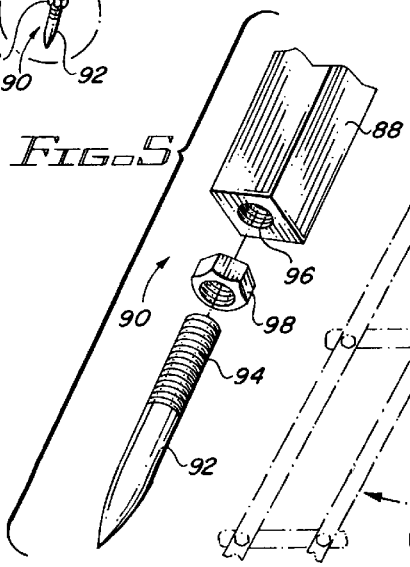
FIG. 5 is an expanded view of the foot of the device depicted in the circled area numbered 5 in FIG. 1.

Foot 90 illustrated in FIGS. 1 and 5, is best used to allow a user to dig in for traction. Foot 90 includes a tapered tip 92 having a threaded portion 94 which partially extends a threaded opening 96 positioned on the bottom of leg 88. A nut 98 firmly, but detachably, secures tip 92 to leg 88. As shown in FIG. 1, an identical arrangement is used to secure tip 92 to the bottom of lower square tubes 20 on leg assemblies 12.

Figure 8:
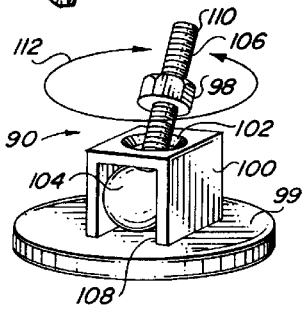
FIG. 8 is an alternate embodiment of a foot for use in connection with the present invention.

An alternate embodiment best seen in FIG. 8 provides a foot 90 comprising a flat rotatable disk 99 having a housing 100 mounted thereon. Housing 100 is generally box-shaped whose upper surface includes an upper opening 102. A ball 104 is captured within housing 100 and threadedly engages shaft 106 which extends through upper opening 102. Replacement of ball 104 is accomplished by disengaging shaft 106 and removing ball 104 through large side opening 108.

As with tapered tip 92, threaded portion 110 of shaft 106 is positioned opposite ball 104 and is extends partially into threaded opening 96 and is secured thereto by nut 98. Ball 104 and housing 100 allow complete rotation of disk 99 as shown by arrow 112 as well as partial rotation about a vertical axis to compensate for rough surfaces. Disk 99 is desireable for those areas in which weight distribution may be needed, i. e., sandy terrain.

Figure 14:
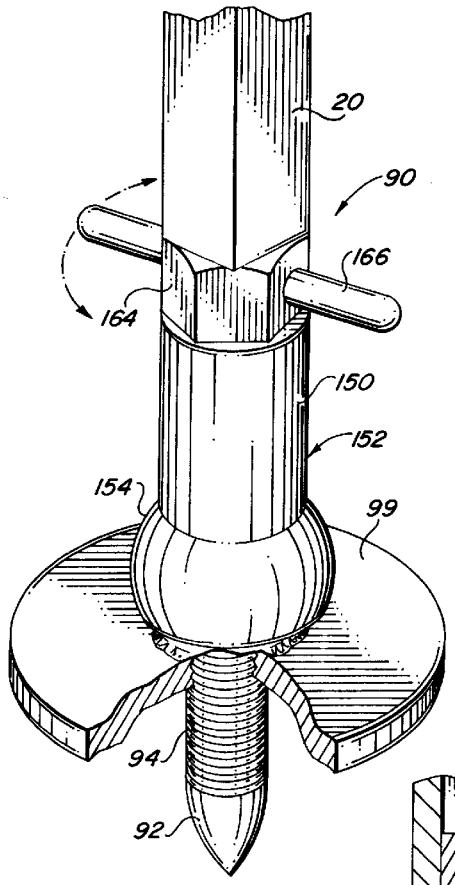
FIG. 14 is a perspective view of an alternate embodiment of a foot for use in connection with the present invention having a tip in an exposed position.
Figure 15:
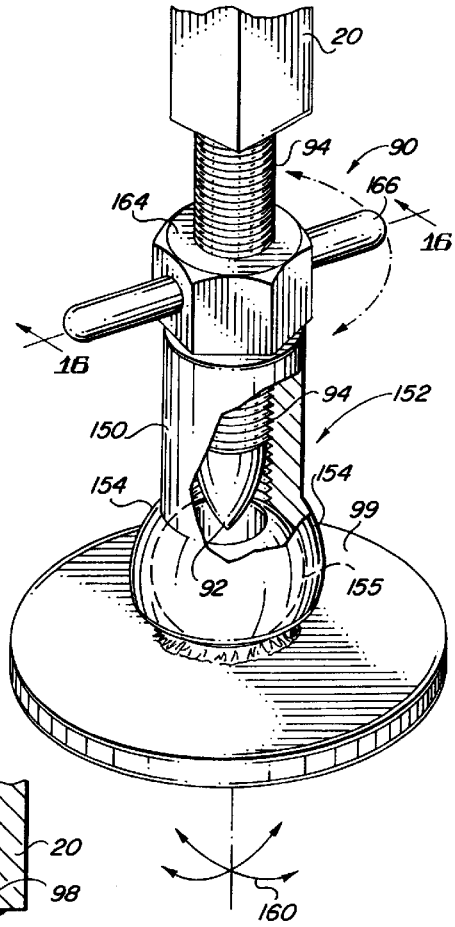
FIG. 15 is a perspective view of the alternate embodiment of FIG. 15 having the tip in the recessed position.
Figure 16:
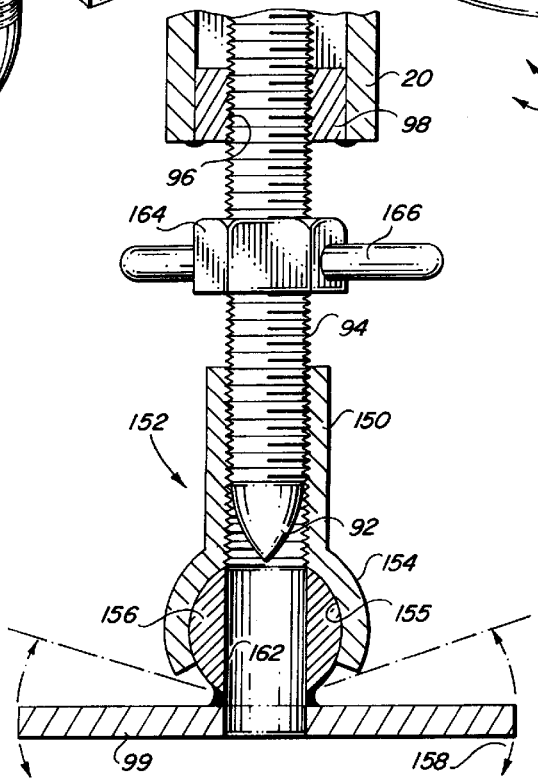
FIG. 16 is a cross sectional view of the alternate embodiment of FIG. 15 taken along line 16—16.

Still another alternate embodiment of foot 90 is best seen in FIGS. 14–16. As with the foot embodiment depicted in FIGS. 1 and 5, foot 90 includes tapered tip 92 having threaded portion 94 which partially extends into threaded opening 96 positioned on the bottom of leg 88. Nut 98 firmly, but detachably, secures tip 92 to the bottom of lower square tubes 20 on leg assemblies 12.

However, opposite lower square tube 20, tapered tip 92 and the lower portion of threaded portion 94 extend into a threaded tube portion 150 of a casing 152. Tube portion 150 and portion 94 are threadedly engaged. Casing 152 further includes a lower portion 154 which is generally a hemisphere having a hollow interior 155 with a cross sectional arc extending slightly past 180 degrees.

A mating sphere 156 is preferably snap fit and thereby rotatably captured within hollow interior 155 of lower portion 154 as best seen in FIG. 16. Mounted on the portion of sphere 156 extending from hollow interior 155 is rotatable disk 99. Similar to the embodiment of FIG. 8, sphere 156 and casing 152 allow rotation of disk 99 as shown by arrows 158 and 160 which is desireable for those areas in which weight distribution may be needed, i. e., sandy terrain.

However, in this embodiment sphere 156 and disk 99 further include a bore 162 extending completely therethrough. When aligned with threaded portion 94, bore 162 is large enough to allow tip 92 to extend completely therethrough.

To use on sandy terrain requiring disk 99, casing 150 via threaded tube portion 150 is screwed down threaded portion 94 until tip 92 is completely recessed within lower portion 154 as best seen in FIGS. 15 and 16. A locknut 164 having locknut handles 166 is used to firmly secure casing 150 as desired. In the recessed position, disk 99 engages the ground in a manner described previously.

To use tip 92, casing 150 via threaded tube portion 150 is screwed up threaded portion 94 until tip 92 extends through casing 150 and bore 162 and is completely exposed as best seen in FIG. 14. Locknut 154 is used to firmly secure casing 150 as desired. In the exposed position, tip 92 engages the ground in a manner as described previously.

The embodiments illustrated for the foot are illustrative only. Those skilled in the art will recognize that many other such arrangements can be made suitable for differing terrains.

Figure 13:
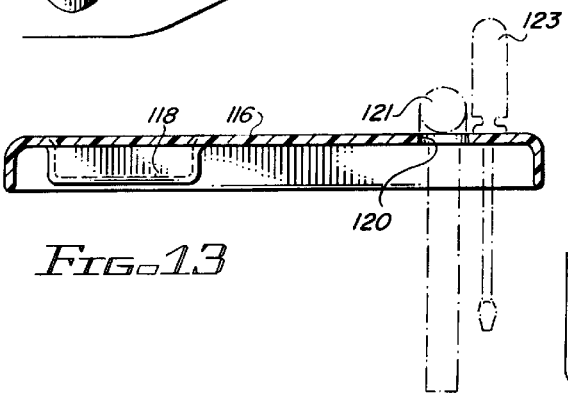
FIG. 13 is a cross sectional side view of the top step depicted in FIG. 12 taken along line 13—13.
Figure 12:
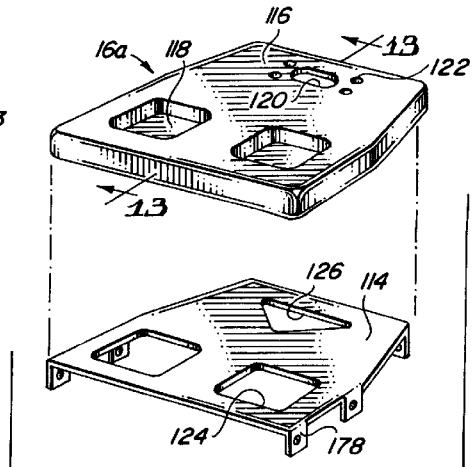
FIG. 12 is a perspective view of an alternate embodiment of the top step of the present invention.

FIGS. 12 and 13 illustrate an alternate embodiment of top step 16 denoted as 16*a*. As shown therein, in this embodiment, top shelf 16*a* comprises a base 114 with a top 116 detachably fitting over said base. In the illustrated embodiment, top 116 includes two trays 118 suitable for holding items such as nuts and bolts. An oval hole 120 suitable for retaining a hammer 121, and a plurality of small circular holes 122 suitable for holding a screwdriver 123 are found in top 116.

Square gaps 124 correspond to trays 118 and triangular gap 126 corresponding to holes 120 and 122 are in base 114 to allow top 116 to mount atop base 114. Base 114 also includes ears 78 and lips 22 to allow mounting of step assembly 16 and leg assemblies 14 thereto. The arrangement shown in FIGS. 12 and 13 allows a user to detachably mount tools and other equipment as needed.

Although only certain embodiments have been illustrated and described, it will be apparent to those skilled in the art that various changes and modifications may be made therein without departing from the spirit of the invention or from the scope of the appended claims.

What is claimed is:

1. A ladder comprising:

a top step, two leg assemblies mounted to the top step, each leg assembly having means for adjusting the length thereof and a foot, a step assembly mounted to the top step, the step assembly having a plurality of steps and a foot, the step assembly foot and the two leg assembly feet forming a tripod configuration whereby the ladder rests upon said three feet, means for pivoting the leg assembly and the step assembly from a closed position in which the leg assemblies and the step assembly are extend vertically downward from the top step to an angular position in which the leg assemblies and the step assembly are angularly displaced from vertical and oriented along radial axes positioned 120 degrees from one another in the tripod configuration, and means for locking each leg assembly and the step assembly to an angular position along the radial axes positioned 120 degrees from one another.

2. The ladder in accordance with claim 1 wherein means for adjusting the length of the leg assemblies comprises an upper tube and a lower tube slidably received within said the upper tube and means for securing the lower tube and the upper tube at the desired length.

3. The ladder in accordance with claim 2 wherein the lower tube includes a plurality of paired mounting holes extending longitudinally along said lower tube, the upper tube includes a single pair of mounting holes proximate to the lower tube, and a pin which extends through the single pair of mounting holes in the upper tube and one of the plurality of paired mounting holes in the lower tube at the desired length.

4. The ladder in accordance with claim 2 wherein the lower tube includes a plurality of single holes extending longitudinally along the lower tube, the upper tube includes a securing hole positioned proximate to the lower tube, and a short pin extends through the securing hole and one of the plurality of single holes in the lower tube at the desired length.

5. The ladder in accordance with claim 2 further comprising two alignment channels mounted to the top step, each leg assembly being received within one of the alignment channels, the alignment channels holding the leg assemblies at the radial axes positioned at 120 degrees from one another.

6. The ladder in accordance with claim 5 wherein each of the alignment channels is formed from two lips, the upper tube being received between the two lips, the means for pivoting being a bolt extending through the lips and the upper tube.

7. The ladder in accordance with claim 1 wherein the locking means comprises three hydraulic cylinders, two of the hydraulic cylinders being pivotally mounted between the leg assemblies and the top step and the third hydraulic cylinder being pivotally mounted between the step assembly and the top step.

8. The ladder in accordance with claim 1 wherein the plurality of steps are in a spaced parallel relationship.

9. The ladder in accordance with claim 8 further comprising two front mounting arms and two middle mounting arms, wherein each of the front mounting arms is paired with one of the middle mounting arms and mounted on opposing sides of the top step, each of the plurality of steps being rotatably secured each of the four mounting arms, each pair of mounting arms in combination with the top step and each of the plurality of steps defining a parallelogram.

10. The ladder in accordance with claim 1 wherein the step assembly further includes a Y-shaped base having arms extending downwardly from the front mounting arms to join a leg, the foot being mounted to the leg.

11. The ladder in accordance with claim 1 wherein each of the feet comprise a tapered tip.

* * * * *